US008069613B2

(12) United States Patent
Lin

(10) Patent No.: US 8,069,613 B2
(45) **Date of Patent: *Dec. 6, 2011**

(54) MULLION ASSEMBLY FOR DOUBLE DOOR

(75) Inventor: Chung-Liang Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 246 days.

This patent is subject to a terminal disclaimer.

(21) Appl. No.: 12/578,614

(22) Filed: Oct. 14, 2009

(65) Prior Publication Data

US 2011/0083368 A1 Apr. 14, 2011

(51) Int. Cl.
*E06B 5/00* (2006.01)

(52) U.S. Cl. ..... 49/365

(58) Field of Classification Search ..... 49/365, 49/1, 7, 394, 395; 52/204.1, 206
See application file for complete search history.

(56) References Cited

U.S. PATENT DOCUMENTS 5,435,102 A * 7/1995 McCarthy ..... 49/365
5,450,697 A * 9/1995 Prucinsky et al. ..... 52/210
5,471,792 A * 12/1995 Higgins et al. ..... 49/365
5,765,309 A * 6/1998 Mamchych ..... 49/365
5,794,382 A 8/1998 Prucinsky ..... 49/365
5,890,319 A * 4/1999 Haeck et al. ..... 49/365
5,941,023 A * 8/1999 Mamchych ..... 49/365
6,131,338 A * 10/2000 Haeck et al. ..... 49/365
6,427,387 B1 * 8/2002 Hunt ..... 49/365
6,968,658 B2 * 11/2005 Hales ..... 52/210
7,000,355 B2 * 2/2006 Flory et al. ..... 49/365
2002/0053170 A1 * 5/2002 Hunt ..... 49/365
2003/0046883 A1 * 3/2003 Hales ..... 52/111
2004/0182009 A1 * 9/2004 Flory et al. ..... 49/365
2009/0217604 A1 * 9/2009 Mamchych ..... 52/208

* cited by examiner

*Primary Examiner* — Jerry Redman
(74) *Attorney, Agent, or Firm* — Alan Kamrath; Kamrath & Associates PA

(57) ABSTRACT

A mullion assembly (10) includes a top mounting block (92) attached to a top beam (24) of a door frame (22). A bottom mounting block (108) is mounted on a floor (20) spaced from the top beam (24) in a vertical direction. A post (40) is detachably mounted between top and bottom mounting blocks (92, 108). A brace (50) is mounted to a lower end (44) of the post (40). A positioning rod (172) is mounted to the brace (50) and moveable between a locking position and an unlocking position to lock the post (40) between the top and bottom mounting blocks (92, 108). An anchoring rod (214) is mounted to the brace (50) and moveable between an anchoring position and a non-anchoring position, allowing further locking of the post (40) between the top and bottom mounting blocks (92, 108) when the mullion assembly (10) is exposed to a fire.

16 Claims, 15 Drawing Sheets

MULLION ASSEMBLY FOR DOUBLE DOOR

BACKGROUND OF TI-IE INVENTION

The present invention relates to a mullion assembly and, more particularly, to a mullion assembly for a double door mounted in a double doorway.

It is usual to mount a mullion assembly in a double doorway for engaging with two latches of two doors (or known as a double door) pivotably mounted on opposite sides of a door frame. Easy removal of the mullion assembly is required when a full door opening is desired for unobstructed pass purposes. Furthermore, to prevent the doors from being opened when exposed to a fire, it is desirable for the mullion assembly to have enhanced structural strength and fire resistant functions. In a proposed design, the mullion assembly includes a top fitting mounted to the top of a door frame, a bottom fitting assembly mounted to the bottom of the door frame, a mullion head detachably engaged with the top fitting, and a mullion tube mounted between the mullion head and the bottom fitting assembly. A fusible spacer is disposed between the top fitting and the mullion head for accommodating thermal expansion of the mullion assembly in case of fire to resist warping of the mullion assembly. The top fitting includes a vertical slot into which a locking bolt extends. The locking bolt moves upwardly in the vertical slot due to thermal expansion of the mullion assembly to maintain the locked condition without buckling the mullion assembly when the fusible spacer melts due to the heat of the fire. However, a high pressure gas could be generated due to high temperature of combustion or explosion in the fire to destroy the mullion assembly. This is because the engaging force between the mullion tube and the top fitting depends only on the locking bolt and is, thus, insufficient to withstand the high pressure gas, resulting in undesired opening of the doors and flowing of smoke and fire from the outside into the inside.

Thus, a need exists for a mullion assembly with a removable post that allows easy assembly while having improved structural strength to withstand fire.

BRIEF SUMMARY OF THE INVENTION

The present invention solves this need and other problems in the field of mullion assemblies for a double door mounted in a double doorway by providing, in a preferred form, a mullion assembly including a top mounting block adapted to be attached to a top beam of a door frame that includes two opposite side beams to which two doors of the double door are pivotably mounted. Each door includes a door lock having a latch. The mullion assembly further includes a bottom mounting block adapted to be mounted on a floor spaced from the top beam in a vertical direction. The bottom mounting block is aligned with the top mounting block in the vertical direction and includes a positioning hole and an anchor hole spaced from the positioning hole. The mullion assembly further includes a post having two strikes adapted to respectively couple with the latches of the door locks when the doors are in a closed state. The post includes upper and lower ends spaced in the vertical direction. The upper end of the post is detachably engaged with the top mounting block. A brace is mounted to the lower end of the post. A positioning rod is mounted to the brace and moveable in the vertical direction. The positioning rod includes upper and lower ends spaced in the vertical direction. The lower end of the positioning rod is moveable between a locking position engaged in the positioning hole of the bottom mounting block and an unlocking position disengaged from the positioning hole of the bottom mounting block. A key cylinder is mounted to the brace and includes a key-operable actuating member. The actuating member is operably connected to the positioning rod to move the positioning rod between the locking position and the unlocking position. An anchoring rod is mounted to the brace and moveable in the vertical direction. The anchoring rod includes upper and lower ends spaced in the vertical direction. The lower end of the anchoring rod is moveable between an anchoring position engaged in the anchor hole of the bottom mounting block and a non-anchoring position disengaged from the anchor hole of the bottom mounting block. A stop member is mounted to the brace and supports the lower end of the anchoring rod in the non-anchoring position. The stop member is made of material having a melting point lower than the post and the brace. The lower end of the anchoring rod is moved from the non-anchoring position to the anchoring position engaged in the anchor hole of the bottom mounting block when the stop member melts.

In the most preferred form, an anchor bracket is mounted to the brace and includes upper and lower portions spaced in the vertical direction. The upper portion of the anchor bracket includes an upper through-hole, and the lower portion of the anchor bracket includes a lower through-hole spaced from the upper through-hole of the anchor bracket in the vertical direction. The bottom mounting block further includes an anchor hole spaced from the positioning hole. The lower through-hole of the anchor bracket is aligned with and intermediate the upper through-hole of the anchor bracket and the anchor hole of the bottom mounting block in the vertical direction. The anchoring rod extends through the upper and lower through-holes of the anchor bracket, with the upper end of the anchoring rod extending beyond the upper through-hole of the anchor bracket and with the lower end of the anchoring rod extending through the lower through-hole of the anchor bracket. A spring is mounted in the anchor bracket and biases the lower end of the anchoring rod from the non-anchoring position disengaged from the anchor hole to the anchoring position engaged in the anchor hole of the bottom mounting block when the stop member melts The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 6:
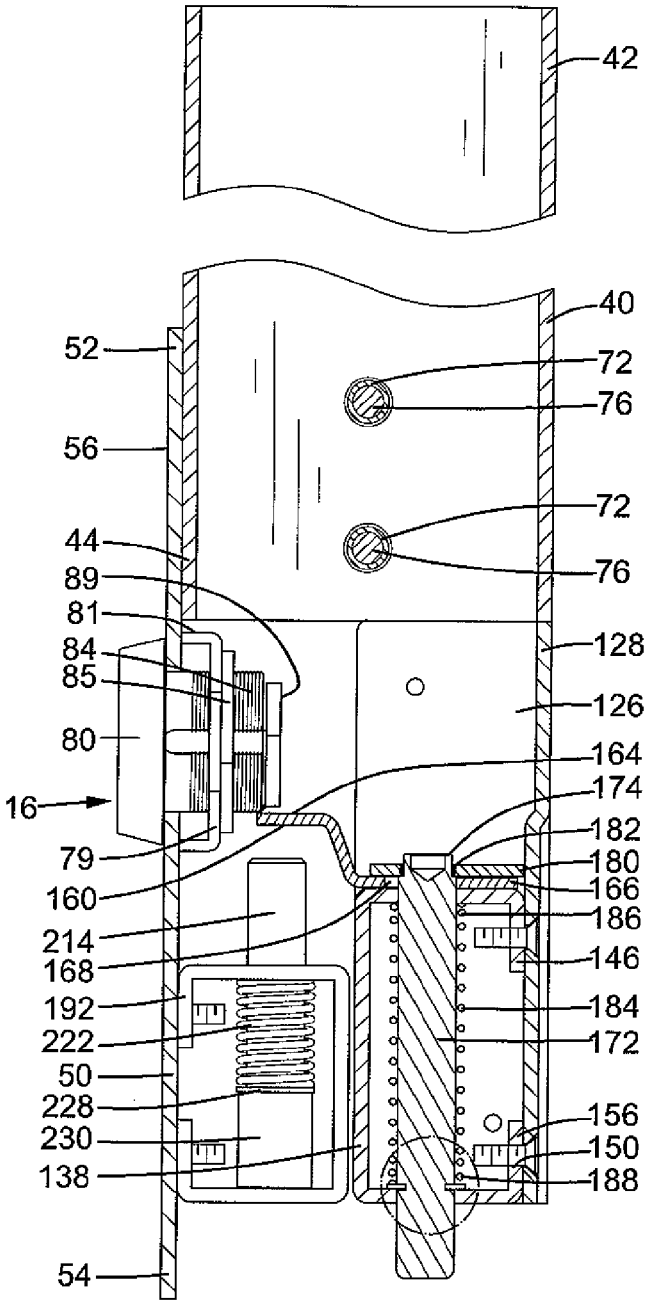
FIG. 6 shows a cross sectional view of the mullion assembly of FIG. 1 taken along section line 6-6 of FIG. 2.
Figure 6A:
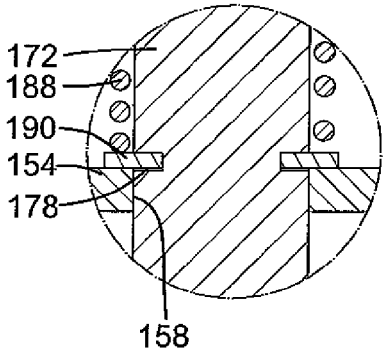

FIG. **6*a* shows an enlarged view of a circled portion of FIG. 6**.

Figure 1:
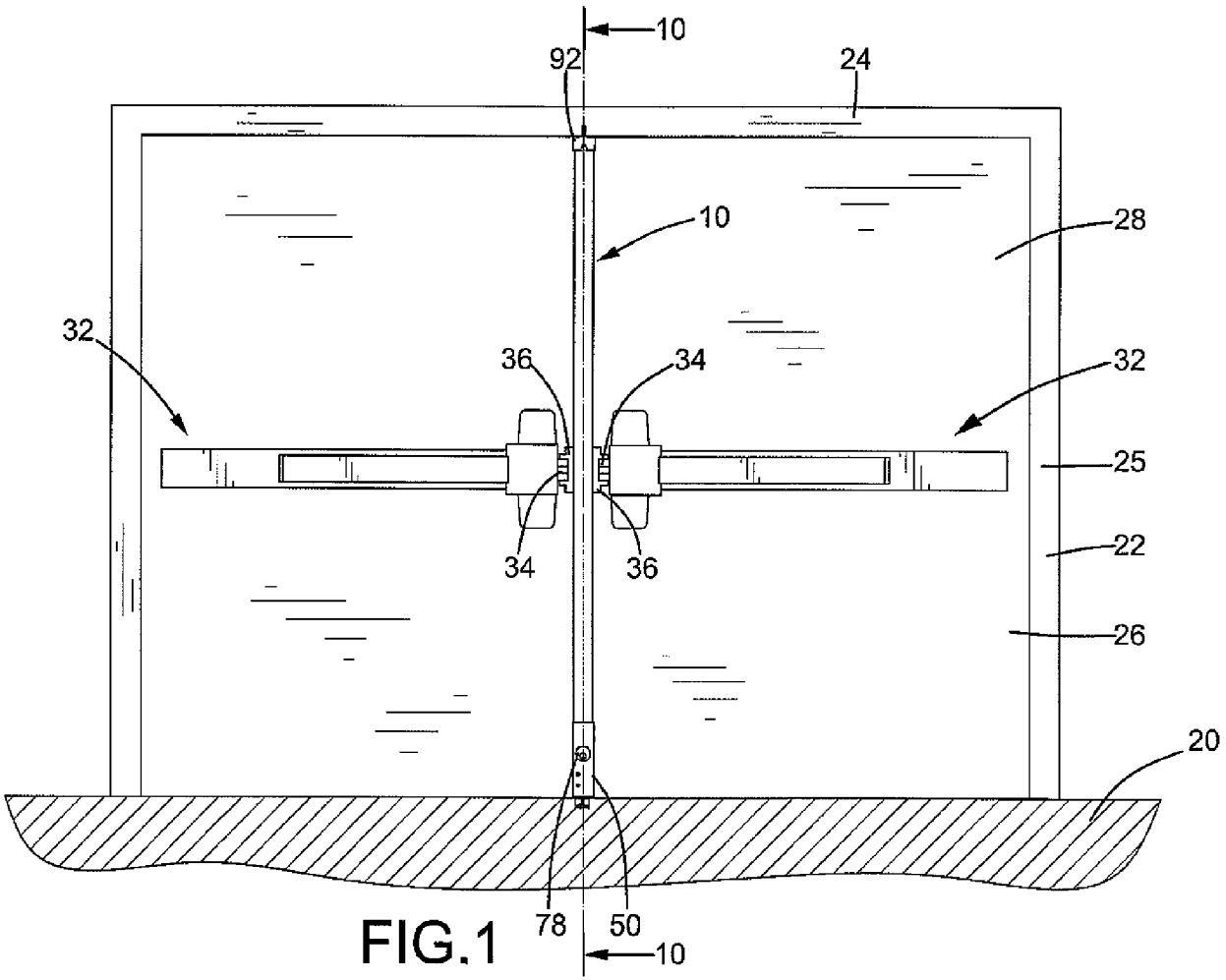
FIG. 1 shows a schematic front view of a mullion assembly according to the preferred teachings of the present invention and a double door to which the mullion assembly is mounted.
Figure 2:
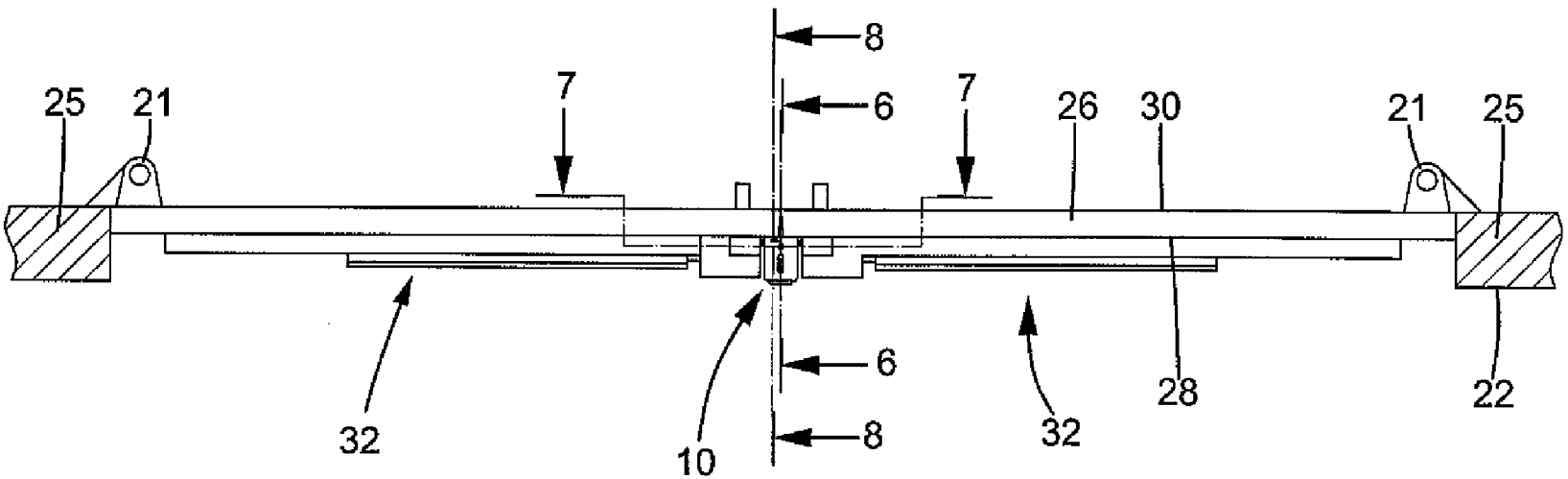
FIG. 2 is a top view of the mullion assembly and the double door of FIG. 1.
Figure 7:
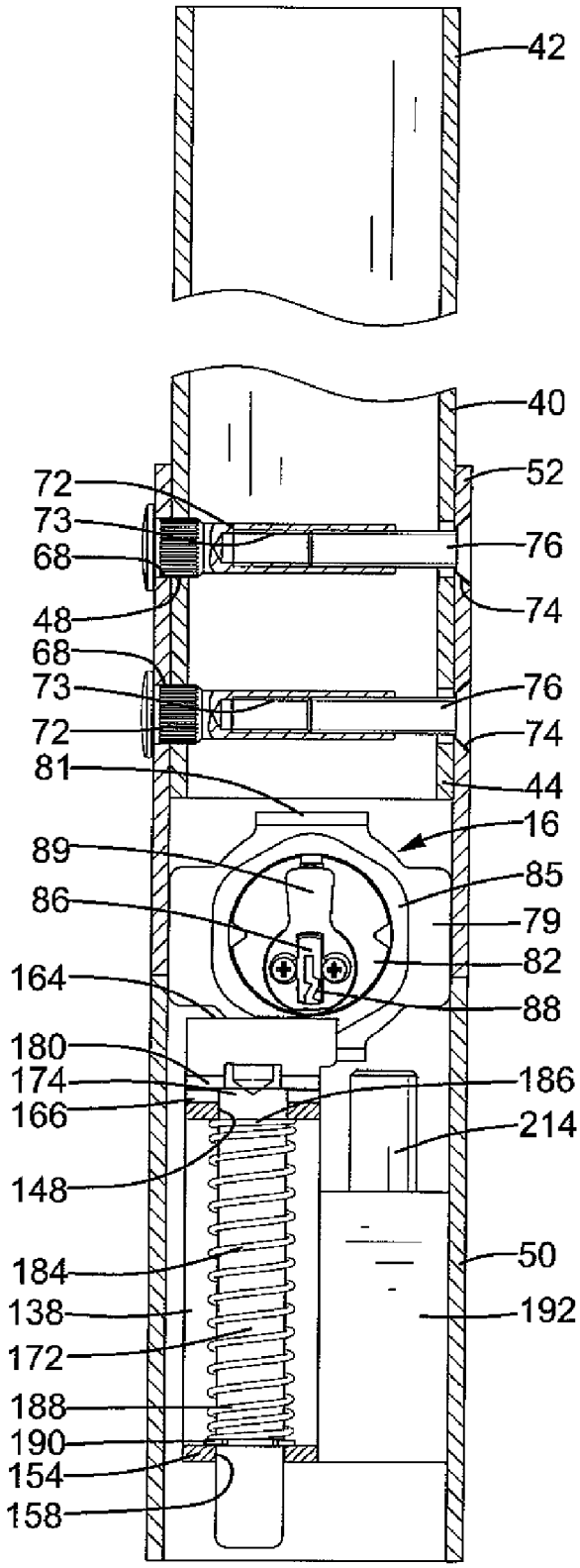

FIG. 7 shows a cross sectional view of the mullion assembly of FIG. 1 taken along section line 7-7 of FIG. 2.

Figure 8A:
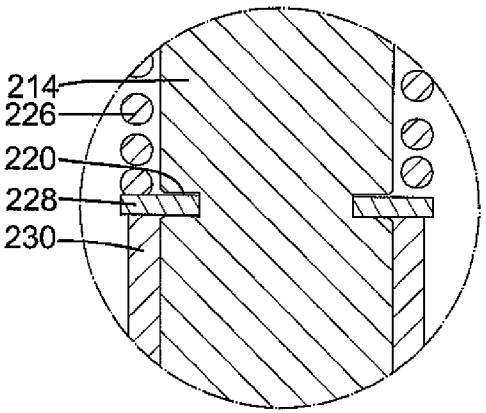
Figure 8:
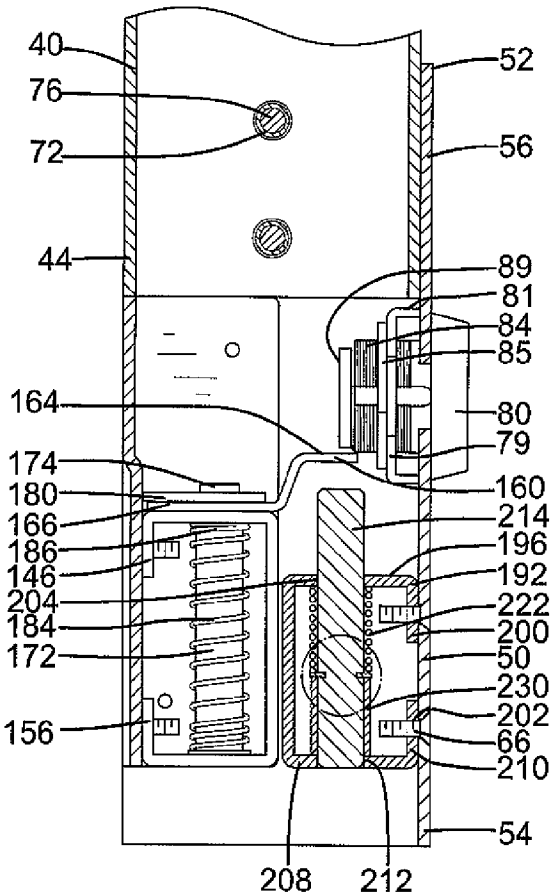

FIG. 8 shows a cross sectional view of the mullion assembly of FIG. 1 taken along section line 8-8 of FIG. 2.

FIG. 8*a* shows an enlarged view of a circled portion of FIG. 8.

Figure 9:
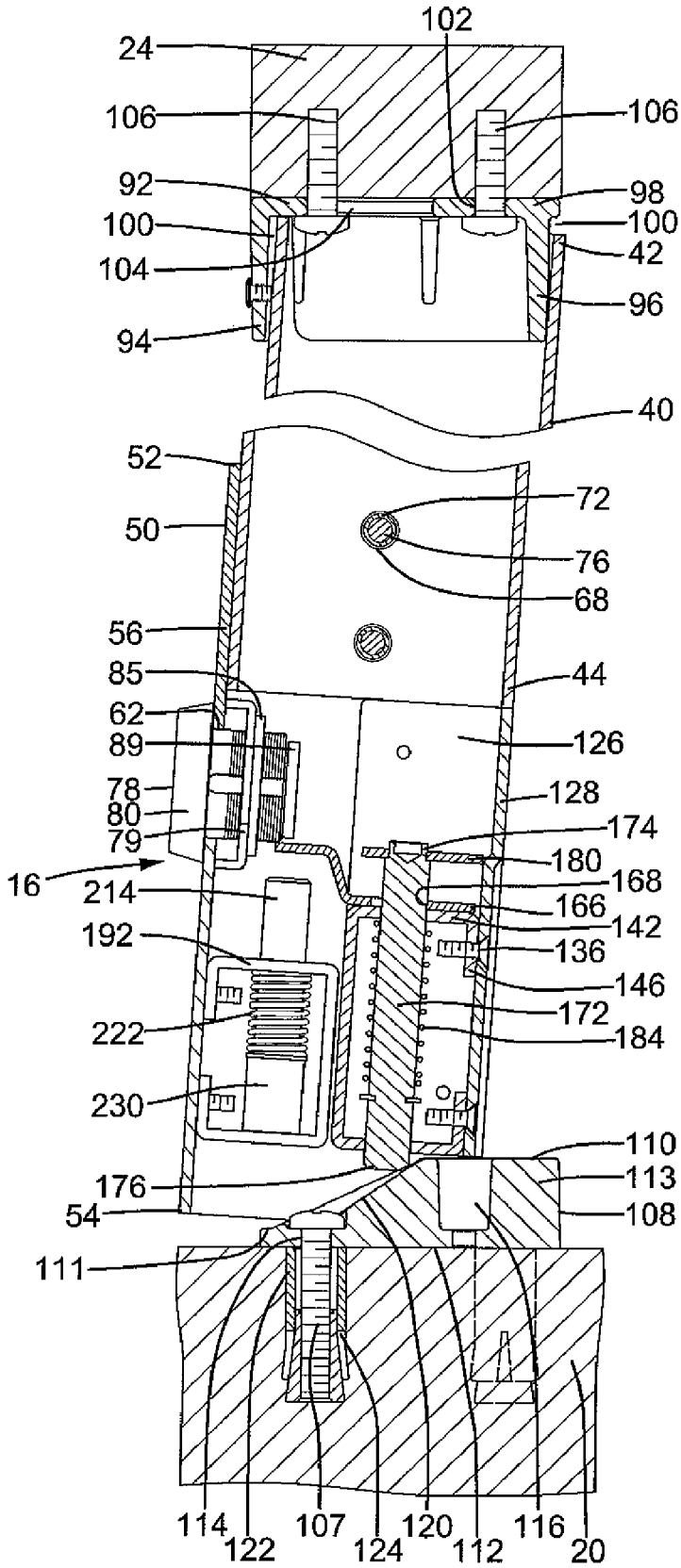

FIG. 9 is a cross sectional view taken along section line 10-10 of FIG. 1, illustrating mounting of the mullion assembly of FIG. 1 to a door frame of the double door.

Figure 10:
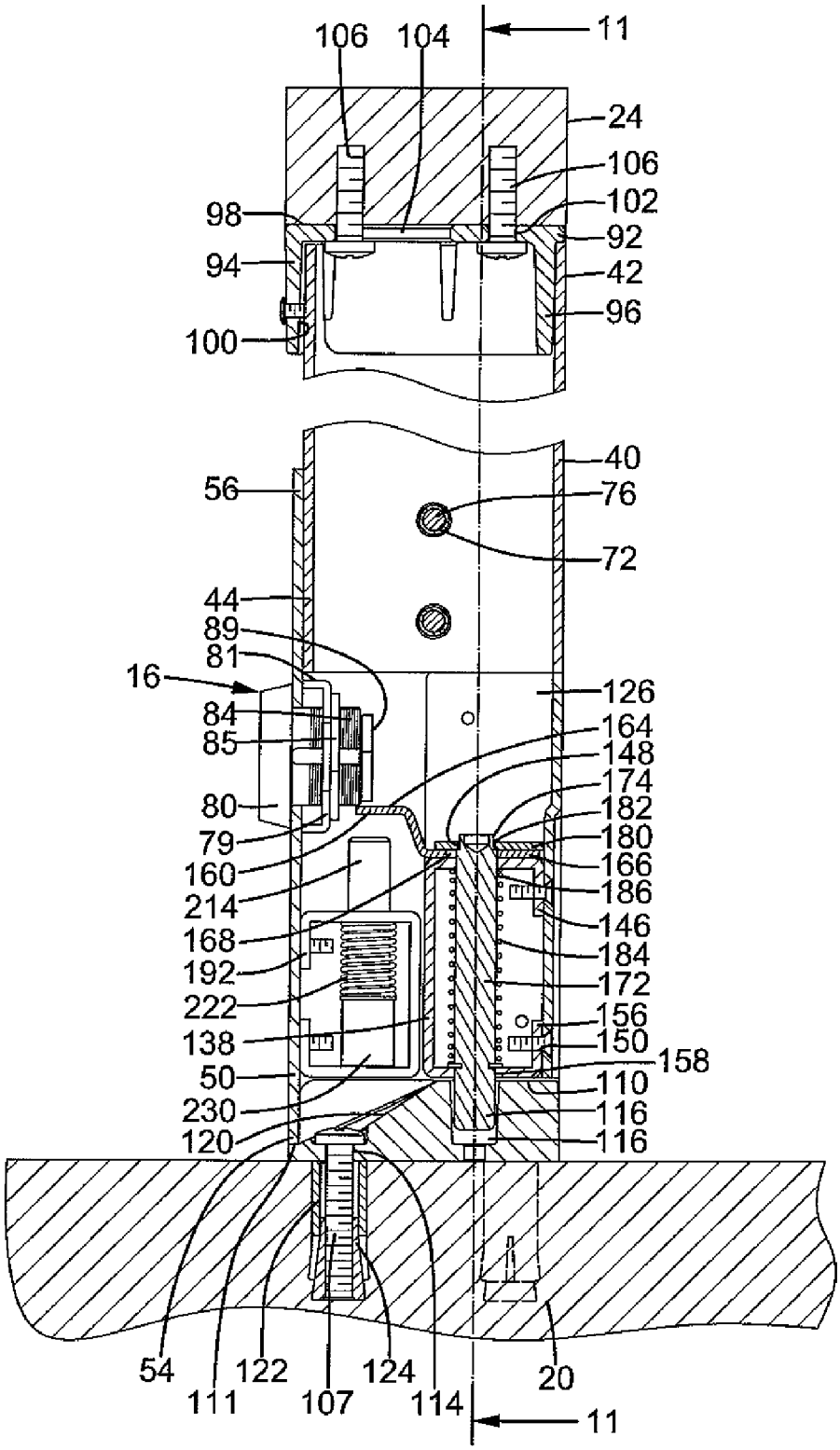

FIG. 10 shows a cross sectional view taken along section line 10-10 of FIG. 1 and similar to FIG. 9, with a post of the mullion assembly assembled between top and bottom mounting blocks.

Figure 11:
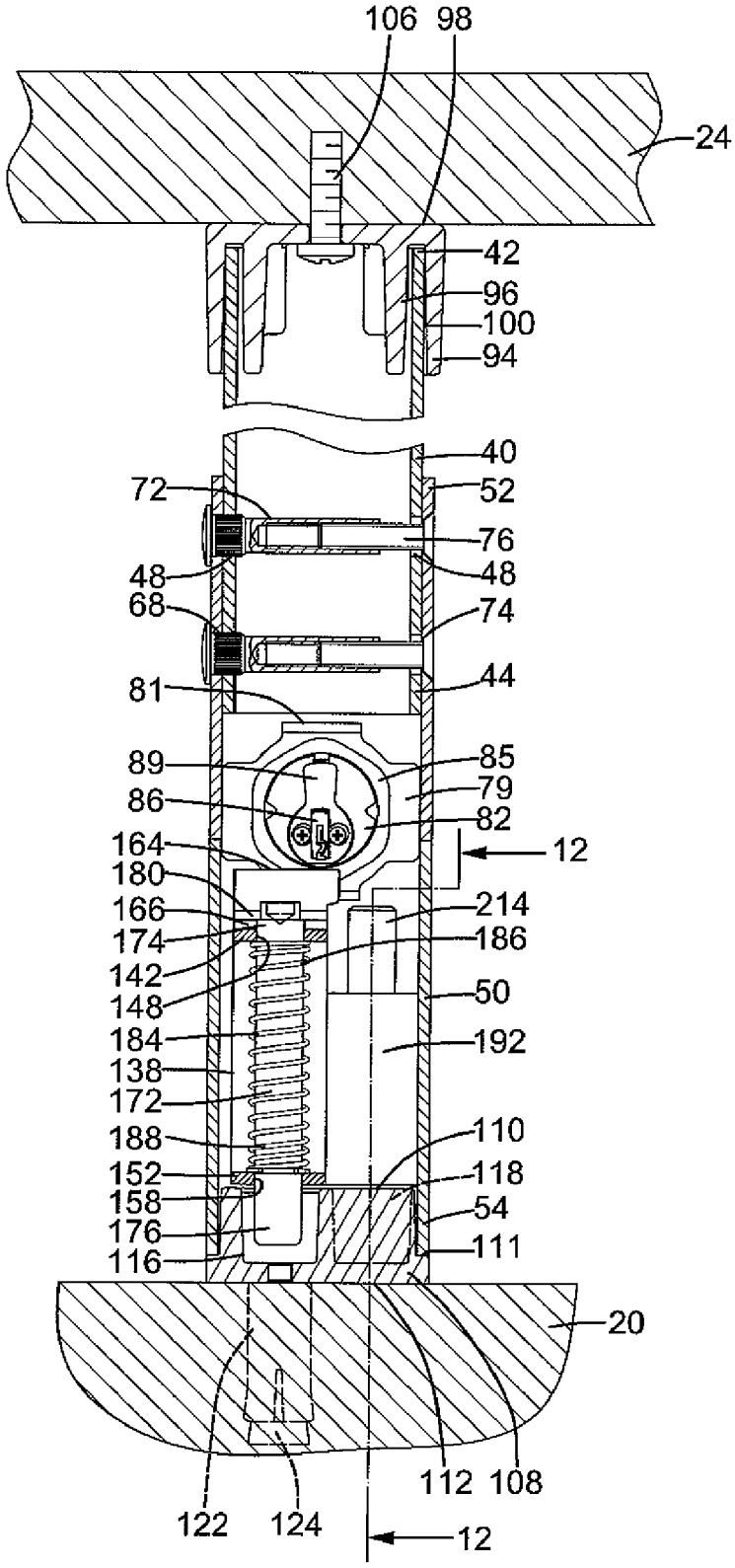

FIG. 11 shows a cross sectional view of the mullion assembly of FIG. 1 taken along section line 11-11 of FIG. 10.

Figure 12:
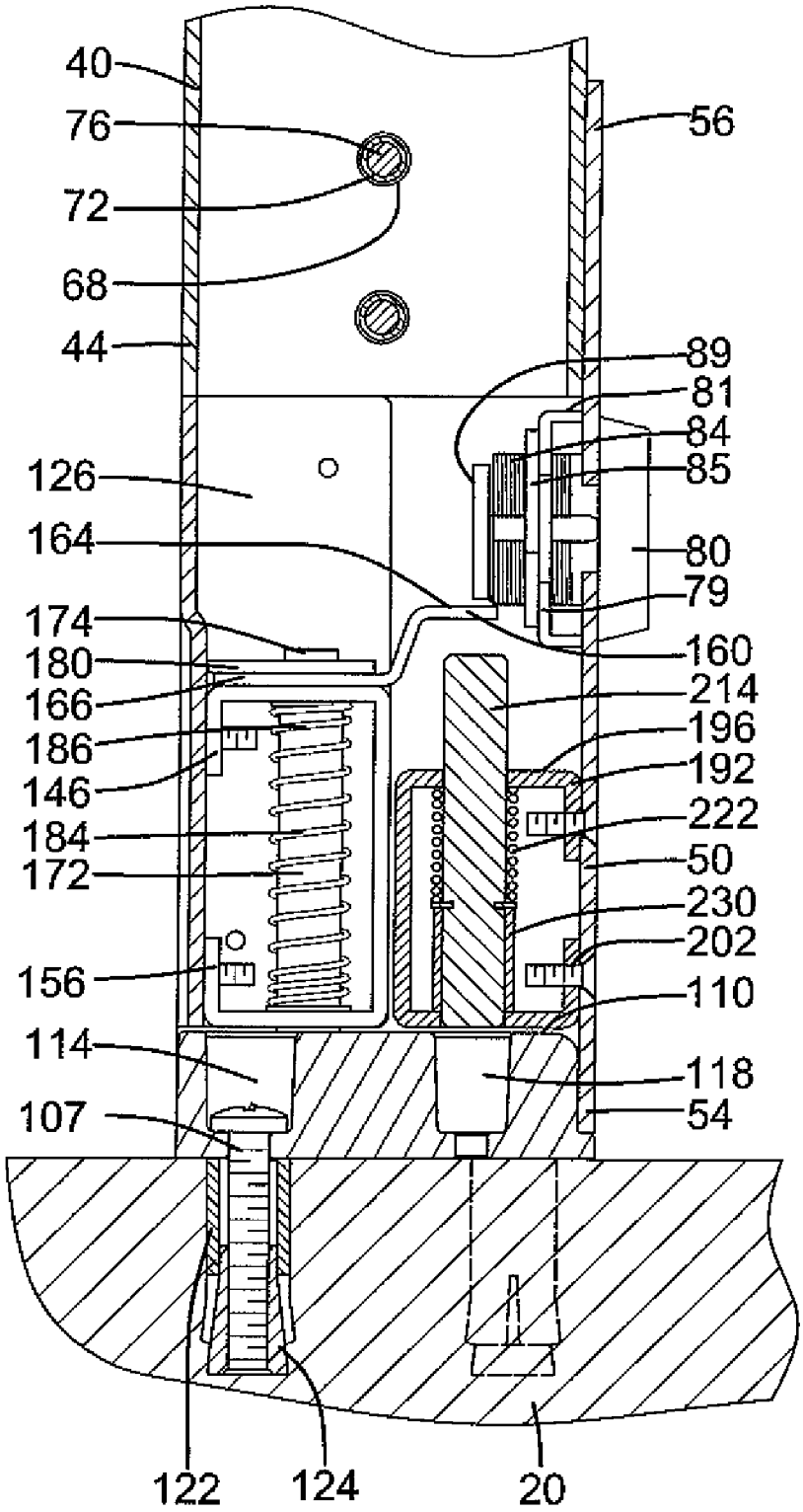

FIG. 12 shows a cross sectional view of the mullion assembly of FIG. 1 taken along section line 12-12 of FIG. 11.

Figure 13:
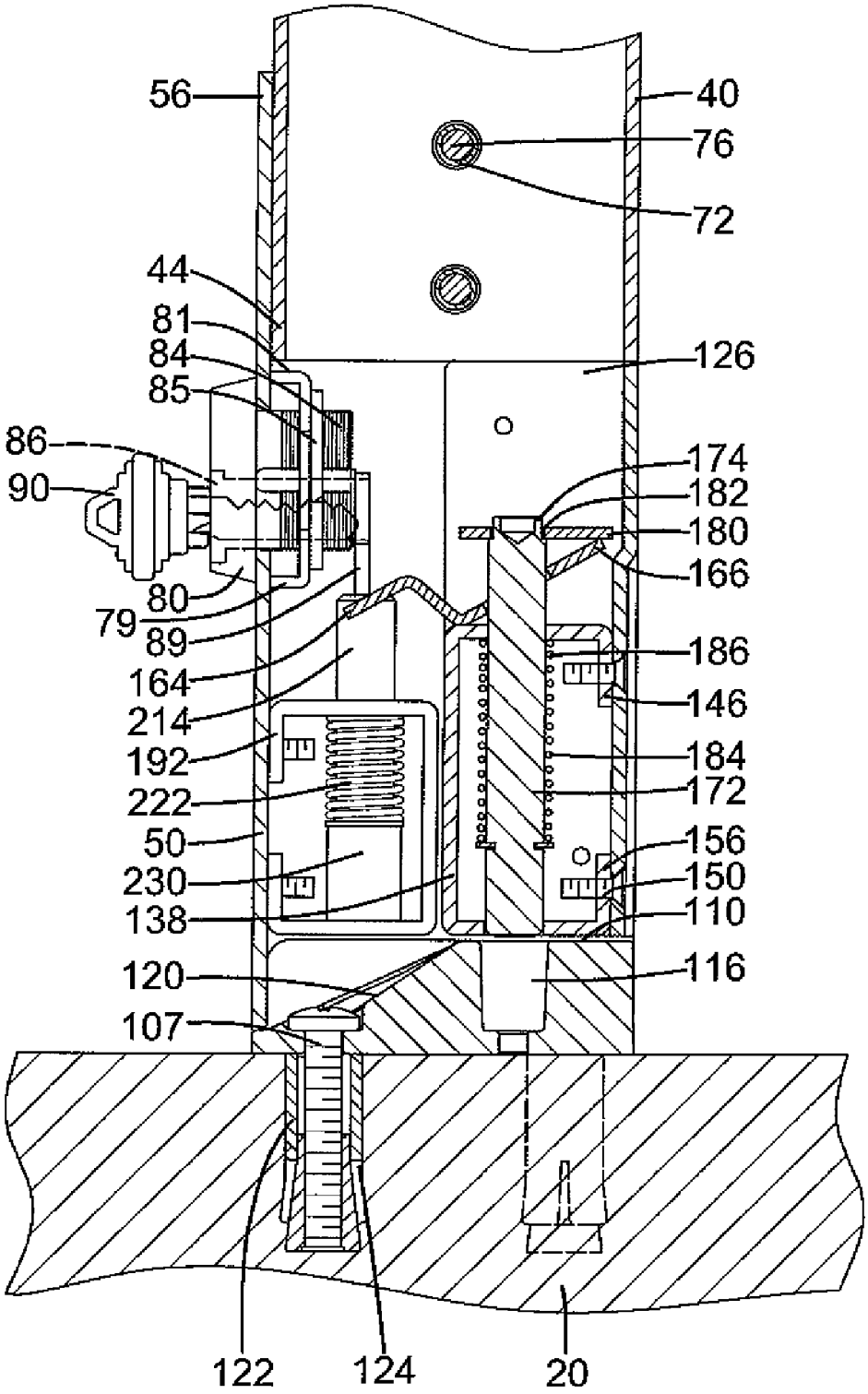

FIG. 13 shows a cross sectional view similar to FIG. 10, with a positioning rod moved upward through activation of a key-operable actuating member.

Figure 14:
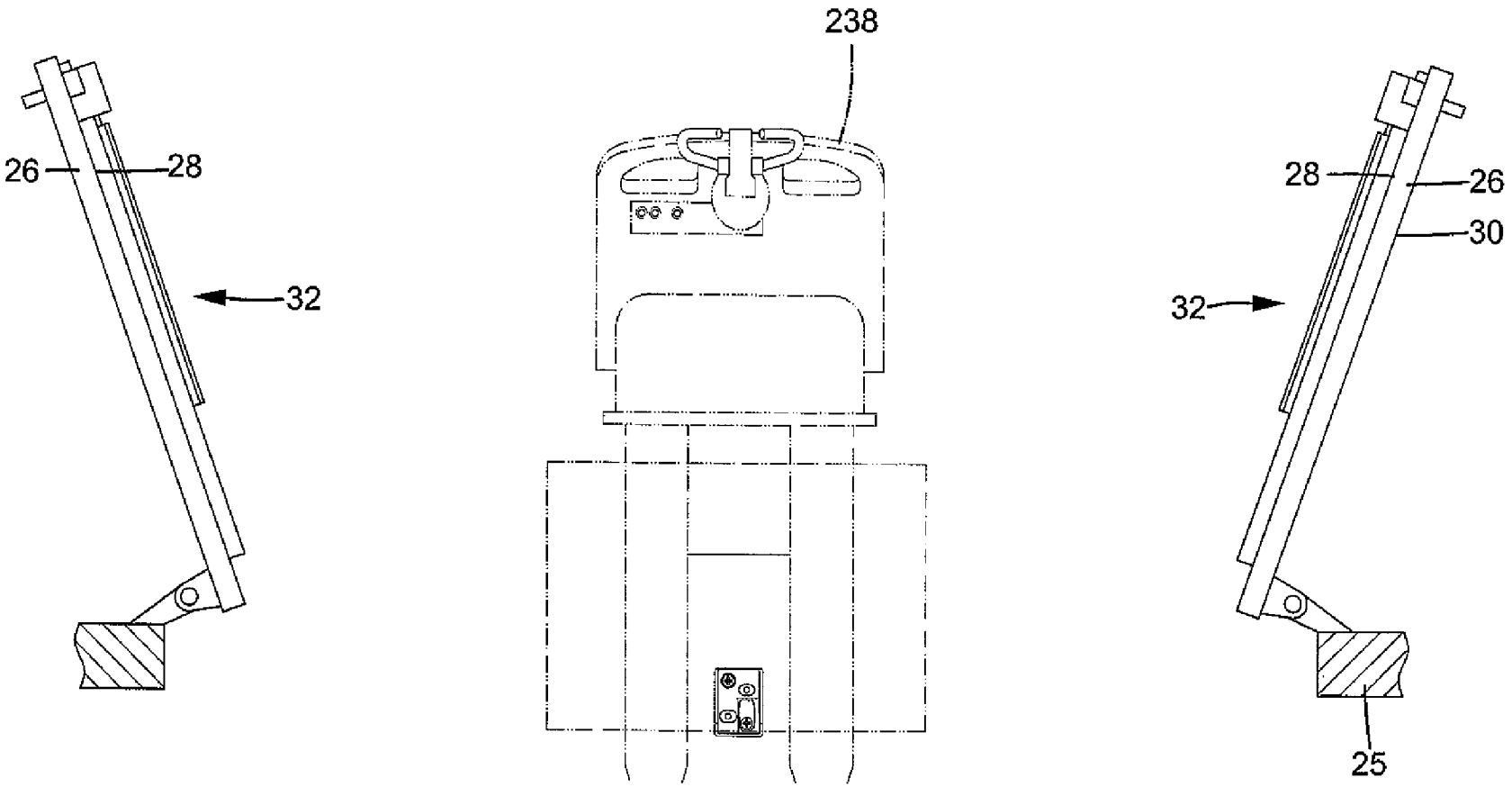

FIG. 14 shows a top view similar to FIG. 10, with two doors of the double door opened and with the post removed from top and bottom mounting blocks.

Figure 15:
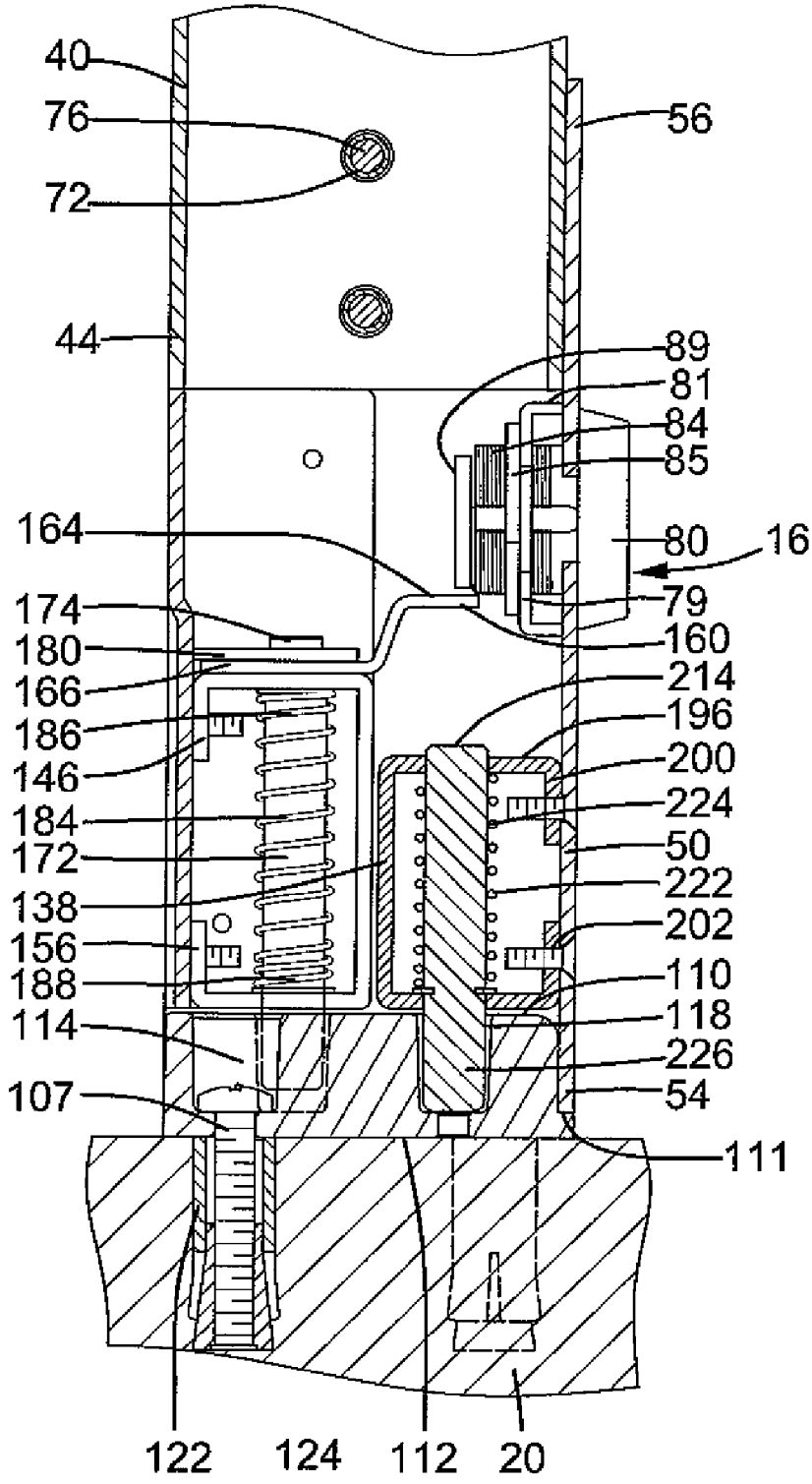

FIG. 15 shows a cross sectional view similar to FIG. 12, with a stop member melted and with an anchoring rod moved downward into an anchor hole in the bottom mounting block.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "top", "bottom", "annular", "vertical" "horizontal" "width" "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A mullion assembly according to the preferred teachings of the present invention is shown in the drawings and generally designated 10. According to the most preferred form shown, mullion assembly 10 is mounted in a door frame 22 for a double door mounted in a double doorway. Door frame 22 includes a top beam 24 spaced from a floor 20 in a vertical direction. Door frame 22 further includes two opposite side beams 25 interconnected by top beam 24 and spaced in a horizontal direction perpendicular to the vertical direction. The double door includes first and second doors 26 respectively and pivotably mounted by pivots 21 to side beams 25 of door frame 22 and each including a door lock 32 having a latch 34 on an end thereof. Each of first and second doors 26 has inner and outer faces 28 and 30 (FIG. 2).

According to the preferred form shown, mullion assembly 10 includes a top mounting block 92 having a top wall 98 with a locking hole 102 and a slot 104. A screw 106 is extended through each of locking hole 102 and slot 104 to attach top mounting block 92 to top beam 24 of door frame 22 (see FIG. 9). Top wall 98 is in the form of a plate having rectangular cross sections and includes upper and lower faces spaced in the vertical direction and a periphery extending between the upper and lower faces. The upper face of top wall 98 is intermediate the lower face of top wall 98 and top beam 24. Top mounting block 92 further includes an outer peripheral wall 94 extending downward from the periphery of top wall 98 in the vertical direction. An inner peripheral wall 96 extends downward from the lower face of top wall 98 in the vertical direction and is located inside of outer peripheral wall 94. A mounting groove 100 is formed between outer and inner peripheral walls 94 and 96. According to the most preferred form shown, outer peripheral wall 94 has substantially U-shaped cross sections and includes a first plate 97 and second and third plates 99 interconnected by the first plate 97 and spaced in a width direction perpendicular to the vertical and horizontal directions such that an opening 95 is defined between the second and third plates 99 of outer peripheral wall 94.

Figure 3:
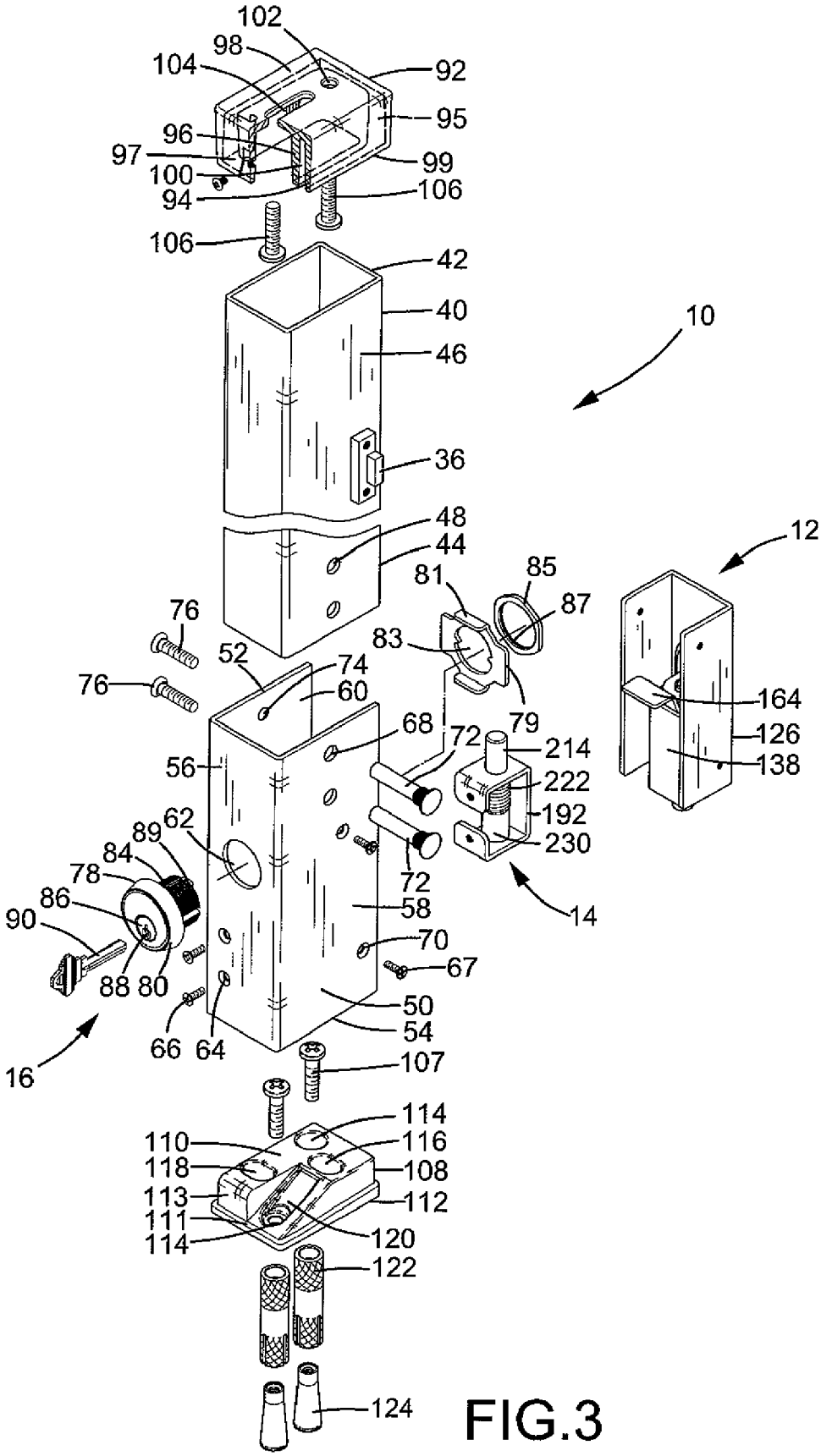
FIG. 3 shows an exploded, perspective view of the mullion assembly of FIG. 1.
Figure 4:
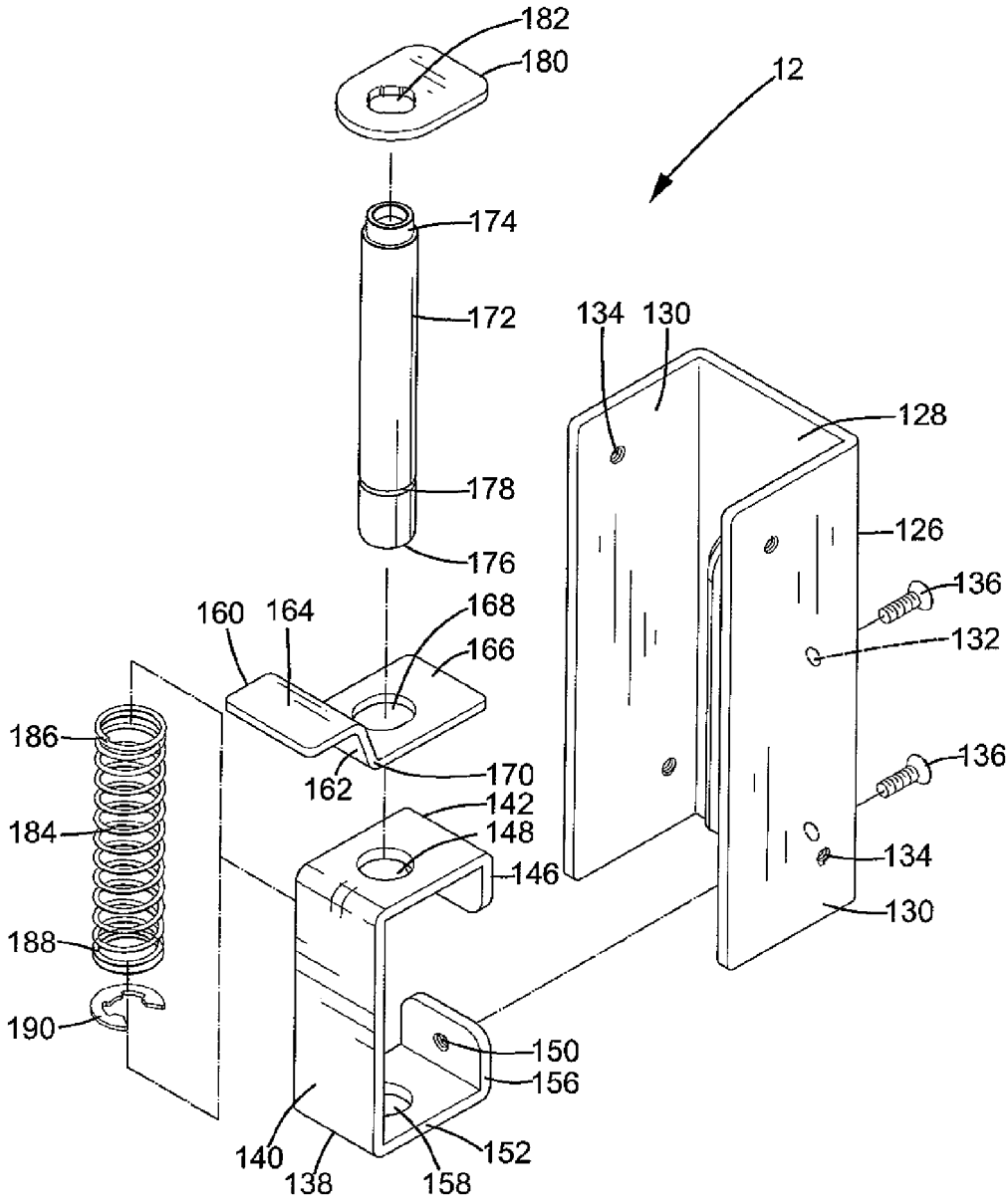
FIG. 4 shows an exploded, perspective view of a positioning device of the mullion assembly of FIG. 1.
Figure 5:
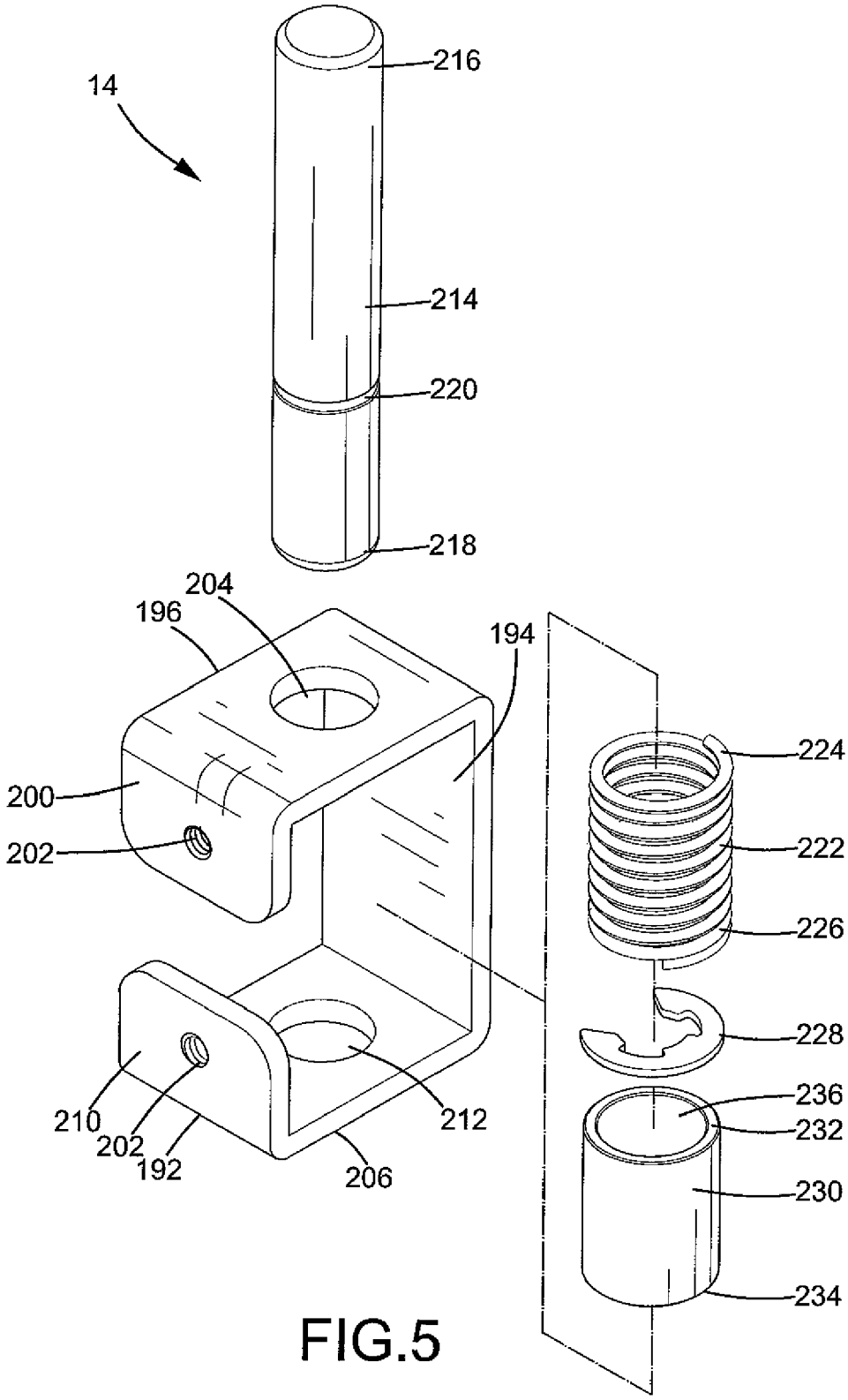
FIG. 5 shows an exploded, perspective view of an anchoring device of the mullion assembly of FIG. 1.

According to the preferred form shown, a bottom mounting block 108 is mounted on floor 20 and aligned with top mounting block 92 in the vertical direction (see FIG. 9). Bottom mounting block 108 includes upper and lower faces 110 and 112 spaced in the vertical direction. Lower face 112 of bottom mounting block 108 is intermediate upper face 110 of bottom mounting block 108 and floor 20. Two spaced screw holes 114 are provided in bottom mounting block 108 and extend from upper face 110 through lower face 112 of bottom mounting block 108. Two sleeves 122 are embedded in floor 20 and aligned with screw holes 114 of bottom mounting block 108 in the vertical direction (see FIGS. 3 and 9). Each sleeve 122 includes a tapered nut 124 therein for receiving a screw 107 which extends through one of screw holes 114 of bottom mounting block 108. Sleeves 122 are squeezed by tapered nuts 124 and expand to securely engage in floor 20 when screws 107 are threaded into tapered nuts 124 so that bottom mounting block 108 can be attached to floor 20 firmly. Bottom mounting block 108 further includes a plurality of side faces 113 extending between upper and lower faces 110 and 112 of bottom mounting block 108 in the vertical direction. A ledge 111 is formed along side faces 113 of bottom mounting block 108 and adjacent to lower face 112. Bottom mounting block 108 further includes a positioning hole 116 and an anchor hole 118 spaced from positioning hole 116. Each of positioning hole 116 and anchor hole 118 has an upper opening in upper face 110 of bottom mounting block 108. Bottom mounting block 108 further includes an inclined face 120 having a lower end adjacent to lower face 112 and an upper end adjacent to the upper opening of positioning hole 116.

According to the preferred form shown, mullion assembly 10 further includes a post 40 that is a hollow tube having rectangular cross sections. Post 40 includes upper and lower ends 42 and 44 spaced in the vertical direction. Post 40 further includes four side walls 46 extending between upper and lower ends 42 and 44. Upper end 42 of post 40 is detachably coupled in mounting groove 100 of top mounting block 92. Lower end 44 of post 40 includes two through-holes 48. Post 40 further includes two strikes 36 respectively coupling with latches 34 of door locks 32 when first and second doors 26 are in a closed state (see FIG. 1).

According to the preferred form shown, mullion assembly 10 further includes a brace 50 that is substantially U-shaped in cross section. Brace 50 includes a first wall 56 and second and third walls 58 and 60 interconnected by first wall 56. Second and third walls 58 and 60 are spaced in the width direction. Brace 50 further includes upper and lower portions 52 and 54 spaced in the vertical direction. Upper portions 52 of second and third walls 58 and 60 respectively include two engaging holes 68 and 74 aligned in the width direction. Through-holes 48 of lower end 44 of post 40 are aligned with engaging holes 68 and 74 of second and third walls 58 and 60 of brace 50 in the width direction. A pin 72 extends through one of engaging holes 68 of second wall 58 and one of through-holes 48 of post 40 and includes a screw hole 73 in an end thereof (see FIG. 7). A screw 76 extends through one of engaging holes 74 of third wall 60 of brace 50 and into screw hole 73 of one of pins 72 to secure upper portion 52 of brace 50 around lower end 44 of post 40. Lower portion 54 of brace 50 is detachably engaged with side faces 113 and rests on ledge 111 of bottom mounting block 108. Further, brace 50 includes a mounting hole 62 in first wall 56, two first fixing holes 64 in a lower portion of first wall 56, and two second fixing holes 70 in each of second and third walls 58 and 60.

According to the preferred form shown, mullion assembly 10 further includes a positioning device 12 that includes a bracket 138, a positioning rod 172, a spring 184, and a driving member 160. Bracket 138 is securely mounted in brace 50 through a mounting plate 126. Mounting plate 126 is substantially U-shaped in cross section and includes a main wall 128 and two side walls 130 interconnected by main wall 128 and spaced in the width direction. Two spaced engaging holes 132 are provided in main wall 128, and two spaced screw holes 134 are provided in each side wall 130. Mounting plate 126 is securely fixed in brace 50 by extending screws 67 through second fixing holes 70 in second and third walls 58 and 60 of brace 50 and into screw holes 134 of side walls 130 of mounting plate 126. Bracket 138 includes upper and lower portions 142 and 152 spaced in the vertical direction and interconnected by a vertical interconnecting wan 140. Upper portion 142 of bracket 138 includes an upper through-hole 148, and lower portion 152 of bracket 138 includes a lower through-hole 158 spaced from upper through-hole 148 in the vertical direction. Lower through-hole 158 of bracket 138 is aligned with and intermediate upper through-hole 148 of bracket 138 and positioning hole 116 of bottom mounting block 108 in the vertical direction (see FIG. 10). Upper and lower portions 142 and 152 of bracket 138 respectively include vertical bends 146 and 156 respectively extending from distal ends of upper and lower portions 142 and 152 in the vertical direction. Each of vertical bends 146 and 156 is spaced from and parallel to vertical interconnecting wall 140 of bracket 138 and includes a screw hole 150. Screws 136 are extended through engaging holes 132 in main wall 128 of mounting plate 126 and into screw holes 150 of bracket 138 to secure bracket 138 in mounting plate 126.

According to the preferred form shown, positioning rod 172 extends through upper and lower through-holes 148 and 158 of bracket 138 and is moveable in the vertical direction. Positioning rod 172 includes upper and lower ends 174 and 176 spaced in the vertical direction. Upper end 174 of positioning rod 172 extends beyond upper through-hole 148 of bracket 138, and lower end 176 of positioning rod 172 is extendible through lower through-hole 158 of bracket 138 between a locking position engaged in positioning hole 116 of bottom mounting block 108 and an unlocking position disengaged from positioning hole 116 of bottom mounting block 108. Positioning rod 172 includes an annular groove 178 intermediate upper and lower ends 174 and 176 of positioning rod 172. A washer 190 is mounted in annular groove 178 to limit an extending extent of lower end 176 of positioning rod 172 through lower through-hole 158 of bracket 138 in the vertical direction. Spring 184 is mounted in bracket 138 and compressible in the vertical direction. Spring 184 includes a first end 186 abutting against upper portion 142 of bracket 138 and a second end 188 abutting against washer 190 so that spring 184 can bias lower end 176 of positioning rod 172 from the unlocking position to the locking position when lower end 176 of positioning rod 172 is aligned with positioning hole 116 of bottom mounting block 108.

According to the preferred form shown, a follower plate 180 is mounted to upper end 174 of positioning rod 172 to move therewith and includes a mounting hole 182 in which upper end 174 of positioning rod 172 is engaged. Driving member 160 includes first and second ends 164 and 166 spaced in the horizontal direction. First end 164 of driving member 160 can be moved between a first position and a second position. Second end 166 of driving member 160 is operably connected to upper end 174 of positioning rod 172. According to the most preferred form shown, second end 166 of driving member 160 is sandwiched between upper portion 142 of bracket 138 and follower plate 180 in the vertical direction and includes an opening 168 through which upper end 174 of positioning rod 172 extends. Opening 168 has a length in the horizontal direction greater than a diameter of upper through-hole 148 of bracket 138, allowing relative movement of driving member 160 to bracket 138. Driving member 160 further includes a bend 162 intermediate first and second ends 164 and 166 of driving member 160 in the horizontal direction. Bend 162 includes a corner 170 abutting on upper portion 142 of bracket 138. Second end 166 of the driving member 160 is pivotable relative to upper portion 142 of bracket 138 with corner 170 acting as a fulcrum when first end 164 of driving member 160 moves between the first and second positions. Further, when first end 164 of driving member 160 is in the first position, lower end 176 of positioning rod 172 is in the locking position engaged in positioning hole 116 of bottom mounting block 108 (see FIG. 10). On the other hand, when first end 164 of driving member 160 is actuated from the first position to the second position, second end 166 of driving member 160 is moved upward together with upper end 174 of positioning rod 172 and lower end 176 of positioning rod 172 is in the unlocking position (see FIG. 13).

According to the preferred form shown, mullion assembly 10 further includes a key cylinder 16 that includes a hollow body 78 having a flange 80 and receiving a lock core 86 which includes a keyway 88. Outer threading 84 is formed on an outer circumference of hollow body 78, allowing key cylinder 16 to be threadedly coupled in mounting hole 62 of first wall 56 of brace 50 with flange 80 abutting first wall 56 of brace 50. A support plate 79 with a mounting hole 83 and a locking ring 85 with a screw hole 87 are received in brace 50 and mounted around hollow body 78 to secure key cylinder 16 in place. Support plate 79 includes two bends 81 spaced in the vertical direction and abutting first wall 56 of brace 50. Support plate 79 further includes two sides spaced in the width direction and abutting second and third walls 58 and 60 of brace 50. An actuating member 89 is mounted on an inner end of lock core 86 and rotatable by operation of a key 90 inserted into keyway 88 so that actuating member 89 is operably connected to first end 164 of driving member 160 to move first end 164 of driving member 160 between the first and second positions.

According to the preferred form shown, mullion assembly 10 further includes an anchoring device 14 having an anchor bracket 192, an anchoring rod 214, a spring 222, and a stop member 230. Anchor bracket 192 is securely mounted in brace 50 and includes upper and lower portions 196 and 206 spaced in the vertical direction and interconnected by a vertical interconnecting wall 194. Upper portion 196 of anchor bracket 192 includes an upper through-hole 204, and lower portion 206 of anchor bracket 192 includes a lower through-hole 212 spaced from upper through-hole 204 in the vertical direction. Lower through-hole 212 of anchor bracket 192 is aligned with and intermediate upper through-hole 204 of anchor bracket 192 and anchor hole 118 of bottom mounting block 108 in the vertical direction. Upper and lower portions 196 and 206 of anchor bracket 192 respectively include vertical bends 200 and 210 respectively extending from distal ends of upper and lower portions 196 and 206 in the vertical direction. Each of vertical bends 200 and 210 is spaced from and parallel to vertical interconnecting wall 194 of anchor bracket 192 and includes a locking hole 202. Fasteners 66 are extended through first fixing holes 64 in first wall 56 of brace 50 and into locking holes 202 of anchor bracket 192 to secure anchor bracket 192 in brace 50. Anchoring rod 214 extends through upper and lower through-holes 204 and 212 of anchor bracket 192 and is moveable in the vertical direction. Anchoring rod 214 includes upper and lower ends 216 and 218 spaced in the vertical direction. Upper end 216 of anchoring rod 214 extends beyond upper through-hole 204 of anchor bracket 192. Lower end 218 of anchoring rod 214 extends through lower through-hole 212 of anchor bracket 192 between an anchoring position engaged in anchor hole 118 of bottom mounting block 108 and a non-anchoring position disengaged from anchor hole 118 of bottom mounting block 108. Anchoring rod 214 includes an annular groove 220 intermediate upper and lower ends 216 and 218 of anchoring rod 214. A washer 228 is mounted in annular groove 220 to limit an extending extent of lower end 218 of anchoring rod 214 through lower through-hole 212 of anchor bracket 192 in the vertical direction. Spring 222 is mounted in anchor bracket 192 and compressible in the vertical direction. Spring 222 includes a first end 224 abutting against upper portion 196 of anchor bracket 192 and a second end 226 abutting against washer 228.

According to the preferred form shown, stop member 230 is mounted in anchor bracket 192 for supporting lower end 218 of anchoring rod 214 in the non-anchoring position. Stop member 230 is made of material having a melting point lower than post 40, brace 50, anchoring rod 214, anchor bracket 192, spring 222, and washer 228. According to the most preferred form shown, stop member 230 is made of a material selected from the group including polyethylene having a melting point of about 90-130° C., polypropylene having a melting point of about 167° C., tin having a melting point of about 231° C., and tin-lead alloy having a melting point of about 183° C. According to the most preferred form shown, stop member 230 is hollow and cylindrical and includes upper and lower end faces 232 and 234 spaced in the vertical direction. Lower end face 234 of stop member 230 rests on lower portion 206 of anchor bracket 192. Washer 228 is located between spring 222 and upper end face 232 of stop member 230. Stop member 230 further includes a through-hole 236 extending from upper end face 232 of stop member 230 through lower end face 234 of stop member 230 in the vertical direction. Lower end 218 of anchoring rod 214 extends through through-hole 236 of stop member 230 and is received in lower through-hole 212 of anchor bracket 192 when lower end 218 of anchoring rod 214 in the non-anchoring position.

FIG. 9 illustrates mounting of mullion assembly 10 in door frame 22 in the double doorway. Firstly, top and bottom mounting blocks 92 and 108 are respectively attached to top beam 24 of door frame 22 and floor 20. Next, post 40 provided with brace 50 is held at an acute angle to floor 20, with upper end 42 of post 40 inserted in mounting groove 100 of top mounting block 92 through opening 95 of outer peripheral wall 94 of top mounting block 92, with lower portion 54 of second and third wall 58 and 60 of brace 50 placed on ledge 111 of bottom mounting block 108, and with lower end 176 of positioning rod 172 abutting against inclined face 120 of bottom mounting block 108 (see FIG. 9). Post 40 is then moved in the horizontal direction and pivoted toward a vertical position at about 90 degrees to floor 20, with lower end 176 of positioning rod 172 being gradually moved upward and guided along inclined face 120 of bottom mounting block 108, and with first wall 56 of brace 50 being moved to abut on one of side faces 113 of bottom mounting block 108. When post 40 reaches the vertical position (see FIG. 10), upper end 42 of post 40 is fully coupled in mounting groove 100 of top mounting block 92, and lower portion 54 of brace 50 is entirely and fittingly engaged around side faces 113 of bottom mounting block 108 and located on ledge 111 of bottom mounting block 108. Furthermore, when lower end 176 of positioning rod 172 moves to upper face 110 of bottom mounting block 108 and aligns with positioning hole 116 of bottom mounting block 108, spring 184 biases lower end 176 of positioning rod 172 to the locking position to lock post 40 between top and bottom mounting blocks 92 and 108. On the other hand, lower end 218 of anchoring rod 214 is aligned with anchor hole 118 of bottom mounting block 108 and supported by stop member 230 in the non-anchoring position.

Mullion assembly 10 according to the preferred teachings of the present invention allows easy removal of post 40 from top and bottom mounting blocks 92. Namely, post 40 can be easily removed from top and bottom mounting blocks 92 and 108 by operating key cylinder 16. Specifically, when positioning rod 172 in the locking position and when key 90 is inserted into keyway 88 of lock core 86 and rotated, actuating member 89 is rotated to actuate first end 164 of driving member 160 so that first end 164 of driving member 160 is moved from the first position to the second position (see FIG. 13), which, in turn, moves lower end 176 of positioning rod 172 from the locking position to the unlocking position disengaged from positioning hole 116 of bottom mounting block 108, allowing removal of post 40 from top and bottom mounting blocks 92 and 108. More specifically, when first end 164 of driving member 160 is moved by actuating member 89 from the first position to the second position, spring 184 is compressed and follower plate 180 is moved together with second end 166 of driving member 160 to move lower end 176 of positioning rod 172 from the locking position to the unlocking position. Furthermore, when lower end 176 of positioning rod 172 is disengaged from positioning hole 116 of bottom mounting block 108, post 40 can be rotated in a reverse direction so that upper end 42 of post 40 is disengaged from top mounting block 92 and that lower portion 54 of brace 50 is disengaged from bottom mounting block 108. Referring to FIG. 14, after mullion assembly 10 is removed and doors 26 are opened, a full door opening is provided, allowing unobstructed pass for pushcarts 238.

Further, mullion assembly 10 according to the preferred teachings of the present invention further provides an improved structural strength and fire resistant functions. Specifically, stop member 230 retains anchoring rod 214 in the non-anchoring position when stop member 230 in normal situations (see FIG. 12). The engaging force between post 40 and top and bottom mounting blocks 92 and 108 depends on positioning rod 172 in the locking position. On the other hand, when the mullion assembly 10 is exposed to a fire and stop member 230 melts by the heat of the fire, lower end 218 of anchoring rod 214 is biased by spring 222 from the non-anchoring position to the anchoring position engaged in anchor hole 118 of bottom mounting block 108 (see FIG. 15). The engaging force between post 40 and top and bottom mounting blocks 92 and 108 is increased by anchoring rod 214 in the anchoring position and is, thus, sufficient to withstand high pressure gas that may occur due to explosion or high temperature of combustion in the fire, preventing doors 26 from undesired opening. Improved structural strength and fire resistant functions are, thus, provided.

Now that the basic teachings of the present invention have been explained, many extensions and variations will be obvious to one having ordinary skill in the art. For example, driving member 160 can be directly fixed to bracket 138 at a location between first and second ends 164 and 166 of driving member 160 such that driving member 160 is pivotable relative to upper portion 142 of bracket 138 between the first position and the second position. Furthermore, stop member 230 can be in the form of a plate positioned on lower portion 206 of anchor bracket 192. Moreover, anchoring device 14 does not have to include spring 222, and anchoring rod 214 can be moved by gravity from the non-anchoring position to the anchoring position when stop member 230 melts.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A mullion assembly for a double door comprising, in combination:

a top mounting block adapted to be attached to a top beam of a door frame for a double door including first and second doors, with the door frame including two opposite side beams to which the first and second doors are pivotably mounted, with each of the first and second doors including a door lock having a latch;

a bottom mounting block adapted to be mounted on a floor spaced from the top beam in a vertical direction, with the bottom mounting block aligned with the top mounting block in the vertical direction, with the bottom mounting block including a positioning hole and an anchor hole spaced from the positioning hole;

a post including upper and lower ends spaced in the vertical direction, with the upper end of the post detachably engaged with the top mounting block, with the post further including two strikes adapted to respectively couple with the latches of the door locks when the first and second doors are in a closed state;

a brace mounted to the lower end of the post;

a positioning rod mounted to the brace and moveable in the vertical direction, with the positioning rod including upper and lower ends spaced in the vertical direction, with the lower end of the positioning rod being moveable between a locking position engaged in the positioning hole of the bottom mounting block and an unlocking position disengaged from the positioning hole of the bottom mounting block;

a key cylinder mounted to the brace and including a key-operable actuating member, with the actuating member being operably connected to the positioning rod to move the positioning rod between the locking position and the unlocking position;

an anchoring rod mounted to the brace and moveable in the vertical direction, with the anchoring rod including upper and lower ends spaced in the vertical direction, with the lower end of the anchoring rod being moveable between an anchoring position engaged in the anchor hole of the bottom mounting block and a non-anchoring position disengaged from the anchor hole of the bottom mounting block; and a stop member mounted to the brace and supporting the lower end of the anchoring rod in the non-anchoring position, with the stop member being made of material having a melting point lower than the post and the brace, and with the lower end of the anchoring rod moved from the non-anchoring position to the anchoring position engaged in the anchor hole of the bottom mounting block when the stop member melts.

2. The mullion assembly as claimed in claim 1, further comprising, in combination: an anchor bracket mounted to the brace and including upper and lower portions spaced in the vertical direction, with the upper portion of the anchor bracket including an upper through-hole, with the lower portion of the anchor bracket including a lower through-hole spaced from the upper through-hole of the anchor bracket in the vertical direction, with the lower through-hole of the anchor bracket aligned with and intermediate the upper through-hole of the anchor bracket and the anchor hole of the bottom mounting block in the vertical direction, with the anchoring rod extending through the upper and lower through-holes of the anchor bracket, with the upper end of the anchoring rod extending beyond the upper through-hole of the anchor bracket, with the lower end of the anchoring rod extending through the lower through-hole of the anchor bracket.

3. The mullion assembly as claimed in claim 2, further comprising, in combination: a first spring mounted in the anchor bracket, with the first spring biasing the lower end of the anchoring rod from the non-anchoring position disengaged from the anchor hole to the anchoring position engaged in the anchor hole of the bottom mounting block when the stop member melts.

4. The mullion assembly as claimed in claim 3, with the stop member being hollow and cylindrical and including upper and lower end faces spaced in the vertical direction, with the lower end face of the stop member abutting on the lower portion of the anchor bracket, with the first spring mounted between the upper end face of the stop member and the upper portion of the anchor bracket, with the stop member further including a through-hole extending from the upper end face of the stop member through the lower end face of the stop member in the vertical direction, with the lower end of the anchoring rod extending through the through-hole of the stop member and received in the lower through-hole of the anchor bracket when the lower end of the anchoring rod in the non-anchoring position.

5. The mullion assembly as claimed in claim 4, with the anchoring rod including a first annular groove intermediate the upper and lower ends of the anchoring rod, with a first washer mounted in the first annular groove and located between the first spring and the upper end face of the stop member, with the first washer retaining the anchoring rod in the non-anchoring position when the stop member does not melt, and with the first spring biasing the lower end of the anchoring rod from the non-anchoring position to the anchoring position when the stop member melts.

6. The mullion assembly as claimed in claim 4, with the stop member being made of a material selected from the group consisting of polyethylene, polypropylene, tin, and tin-lead alloy.

7. The mullion assembly as claimed in claim 6, further comprising, in combination:

a bracket mounted to the brace and including upper and lower portions spaced in the vertical direction, with the upper portion of the bracket including an upper through-hole, with the lower portion of the bracket including a lower through-hole spaced from the upper through-hole in the vertical direction, with the lower through-hole of the bracket aligned with and intermediate the upper through-hole of the bracket and the positioning hole of the bottom mounting block in the vertical direction, with the positioning rod extending through the upper and lower through-holes of the bracket, with the upper end of the positioning rod extending through the upper through-hole of the bracket, with the lower end of the positioning rod extending through the lower through-hole of the bracket; and a driving member including first and second ends spaced in a horizontal direction perpendicular to the vertical direction, with the second end of the driving member being operably connected to the upper end of the positioning rod, with the actuating member being operably connected to the first end of the driving member to move the first end of the driving member between a first position and a second position, with the lower end of the positioning rod is in the locking position engaged in the positioning hole of the bottom mounting block to lock the post between the top and bottom mounting blocks when the first end of the driving member is in the first position, and with the lower end of the positioning rod is in the unlocking position disengaged from the positioning hole of the bottom mounting block when the first end of the driving member is in the second position, allowing removal of the post from the top and bottom mounting blocks.

8. The mullion assembly as claimed in claim 7, further comprising, in combination: a second spring mounted in the bracket and biasing the lower end of the positioning rod from the unlocking position to the locking position, with the second spring being compressed when the first end of the driving member is in the second position.

9. The mullion assembly as claimed in claim 8, with the positioning rod including a second annular groove intermediate the upper and lower ends of the positioning rod in the vertical direction, with a second washer mounted in the second annular groove and located between the second spring and the lower portion of the bracket, with the second spring located between the upper portion of the bracket and the second washer and biasing the lower end of the positioning rod from the unlocking position to the locking position.

10. The mullion assembly as claimed in claim 9, further comprising, in combination: a follower plate mounted to the upper end of the positioning rod, with the upper end of the positioning rod extending beyond the upper through-hole of the bracket , with the second end of the driving member sandwiched between the upper portion of the bracket and the follower plate in the vertical direction, with the second end of the driving member being pivotable relative to the upper portion of the bracket, and with the follower plate being moved together with the second end of the driving member to move the lower end of the positioning rod from the locking position to the unlocking position when the first end of the driving member is moved by the actuating member from the first position to the second position.

11. The mullion assembly as claimed in claim 10, with the driving member further including a bend intermediate the first and second ends of the driving member in the horizontal direction, with the bend including a corner abutting on the upper portion of the bracket, with the second end of the driving member including an opening through which the upper end of the positioning rod extends, and with the second end of the driving member being pivotable about the corner with the corner acting as a fulcrum when the first end of the driving member moves between the first and second positions.

12. The mullion assembly as claimed in claim 10, with the bottom mounting block further including upper and lower faces spaced in the vertical direction, with the lower face of the bottom mounting block intermediate the upper face of the bottom mounting block and the floor, with the positioning hole including an upper opening in the upper face of the bottom mounting block, with the bottom mounting block further including an inclined face having a lower end adjacent to the floor and an upper end adjacent to the upper opening of the positioning hole , with the lower end of the positioning rod being moved upward and guided along the inclined face when installing the post between the top and bottom mounting blocks, with the second spring biasing the lower end of the positioning rod into the positioning hole of the bottom mounting block to lock the post between the top and bottom mounting blocks when the lower end of the positioning rod is aligned with the positioning hole of the bottom mounting block.

13. The mullion assembly as claimed in claim 12, with the brace being substantially U-shaped in cross section and including a first wall and second and third walls interconnected by the first wall, with the second and third walls spaced in a width direction perpendicular to the vertical and horizontal directions, with the brace further including upper and lower portions spaced in the vertical direction, with the upper portion of the brace being fixed to the lower end of the post, with the bottom mounting block further including a plurality of side faces extending between the upper and lower faces of the bottom mounting block in the vertical direction, with a ledge formed along the plurality of side faces of the bottom mounting block, with the lower portion of the brace engaged with the plurality of side faces and resting on the ledge of the bottom mounting block, and with the key cylinder mounted on the first wall of the brace.

14. The mullion assembly as claimed in claim 13, with the lower end of the post being fixed in the upper portion of the brace between the second and third walls of the brace, and with the bracket being fixed in the lower portion of the brace between the second and third walls of the brace.

15. The mullion assembly as claimed in claim 10, with the top mounting block including a top wall, with the top wall including upper and lower faces spaced in the vertical direction and a periphery extending between the upper and lower faces, with the upper face of the top wall intermediate the lower face of the top wall and the top beam, with the top mounting block further including an outer peripheral wall extending downward from the periphery of the top wall in the vertical direction, with the top mounting block further including an inner peripheral wall extending downward from the lower face of the top wall in the vertical direction and located inside of the outer peripheral wall, with a mounting groove formed between the outer and inner peripheral walls, and with the upper end of the post being detachably coupled in the mounting groove of the top mounting block.

16. The mullion assembly as claimed in claim 15, with the outer peripheral wall having substantially. U-shaped cross sections and including a first plate and second and third plates interconnected by the first plate and spaced in the width direction, with the outer peripheral wall including an opening defined between the second and third plates, and with the upper end of the post being coupled in the top mounting block through the opening of the outer peripheral wall.

* * * * *